United States Patent [19]

Robbins, Jr.

[11] 4,312,003

[45] Jan. 19, 1982

[54] FERRITE ANTENNA

[75] Inventor: Henry M. Robbins, Jr., Pittsburgh, Pa.

[73] Assignee: Mine Safety Appliances Company, Pittsburgh, Pa.

[21] Appl. No.: 187,092

[22] Filed: Sep. 15, 1980

[51] Int. Cl.[3] ..... H01Q 7/08

[52] U.S. Cl. ..... 343/788; 343/719

[58] Field of Search ..... 343/719, 777, 778, 841, 343/842

[56] References Cited

U.S. PATENT DOCUMENTS 4,148,036 4/1979 Miller ..... 343/788

*Primary Examiner*—Eli Lieberman

*Attorney, Agent, or Firm*—Thomas H. Murray

[57] ABSTRACT

A ferrite antenna assembly comprising a ferrite rod surrounded by a first coil and positioned within a surrounding ferrite or the like cylinder provided with a second coil. A signal which is 180° out of phase with the signal on the first coil is applied to the second coil to induce a radio-frequency magnetic field in opposition to the field produced by the ferrite rod antenna. The opposing field creates a high reluctance return path for the magnetic flux emitted from the ferrite antenna at angles deviating from the axis of the rod. This forces the magnetic flux from the rod further out from the axis of the antenna, thus increasing the efficiency and range of the antenna.

5 Claims, 1 Drawing Figure

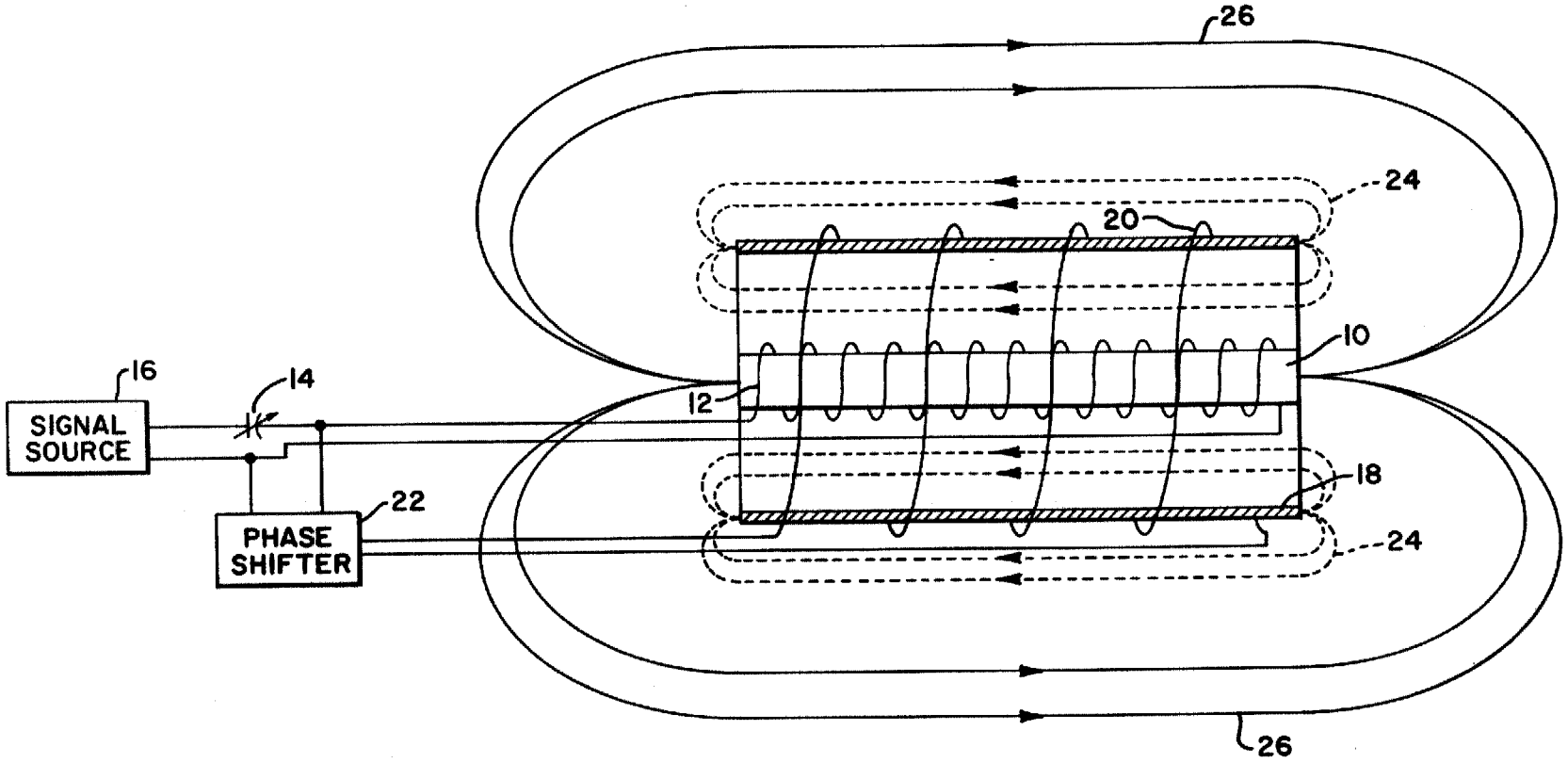
24
10
18
24
26
26
20
12
22
PHASE SHIFTER
14
16
SIGNAL SOURCE

FERRITE ANTENNA

BACKGROUND OF THE INVENTION

A ferrite antenna comprises an elongated coil wound on a rod of ferrite or powdered-iron material and tuned with a series or parallel capacitor so as to be resonant at the operating frequency. The ferrite core increases the radio-frequency flux in the coil and also permits the necessary inductance to be obtained with relatively few turns of wire. In this way, the resistance is kept low and the coil Q is maintained at a high value, much higher than that of an air-wound coil of the same size.

Ferrite antennas of this type are often used in portable communication systems such as those employed in underground mines where the inductive field produced by the antenna is coupled to nearby conductors which carry the signal to a remote location where it is detected. One difficulty with such antennas, however, is that they generate a magnetic moment field which circulates very close to the axis of the antenna. As a result, difficulty is encountered in having the field reach nearby conductors to induce the current flow necessary to sustain near-field communication over long distances as is required in the mining industry.

SUMMARY OF THE INVENTION

In accordance with the present invention, a coil antenna, preferably a ferrite antenna, is surrounded by a cylinder formed of ferrite or other magnetically-permeable material having a single winding thereon. The cylinder winding is powered by the transmitter with a signal which is 180° out of phase with the signal applied to the antenna coil. The net effect is to induce a radio-frequency magnetic field in opposition to the field produced by the ferrite rod antenna. This opposing field creates a high reluctance return path for the magnetic flux emitted from the ferrite antenna at angles deviating from the axis of the antenna ferrite rod. The net effect of the surrounding cylinder excited by the 180° phase-shifted signal is to force the magnetic flux further away from the antenna itself, thus increasing the range of the antenna and its efficiency. The invention permits the construction of a small transmitting antenna for portable use; whereas prior art antennas, particularly ferrite antennas, have to be relatively large to produce the necessary long flux path lengths.

The above and other objects and features of the invention will become apparent from the following detailed description taken in connection with the accompanying single FIGURE drawing which forms a part of this specification.

With reference now to the drawing, there is shown a ferrite antenna installation comprising a rod 10 formed from ferrite material, iron powder or some other material of high magnetic permeability. Surrounding the rod 10 is a first coil 12 having its opposite ends connected through tuning capacitor 14 to a signal source 16. Surrounding the rod 10 and coil 12 is a cylindrical member 18 of high magnetic permeability. The cylinder 18 preferably is formed from ferrite also and has wound thereabout a second large diameter coil 20. The opposite ends of coil 20, in turn, are connected to a phase shifter 22 which shifts the phase of the signal at the output of signal source 16 by 180°.

With the arrangement shown, the 180° phase-shifted signal induces a magnetic field, shown in broken lines and identified by the reference numeral 24. The magnetic field induced by the coil 12 is shown in solid lines and is identified by the reference numeral 26. In the absence of the surrounding ferrite cylinder 18, the magnetic field 26 would be closely adjacent the rod 10; and the range and efficiency of the antenna would be limited. However, by virtue of the field 24 generated by the coil 20 and ferrite cylinder 18, a radio-frequency magnetic field in opposition to the field produced by the ferrite rod antenna 10 is generated. This opposing field creates a high reluctance return path for the magnetic flux emitted from the ferrite antenna at angles deviating from the axis of the rod 10. In effect, the flux lines in field 26 are repelled outwardly from the cylinder 18, thereby increasing the distance at which the antenna can be spaced from a conductor which picks up the signal and transmits it to a remote point.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In an antenna system, a first antenna coil connected to a signal source, a cylinder of magnetically-permeable material coaxial with and surrounding said first antenna coil, and a second coil for inducing magnetic flux in said cylinder and connected to a signal source which is 180° out of phase with respect to said first-mentioned signal source to thereby create a magnetic field in opposition to that produced by the antenna and force the magnetic flux from the antenna further away from the axis of the antenna.

2. The antenna system of claim 1 including a rod of magnetically-permeable material within said first antenna coil.

3. The antenna system of claim 2 wherein said rod is formed of ferrite material.

4. The antenna system of claim 1 wherein said cylinder of magnetically-permeable material is formed from ferrite material.

5. The antenna system of claim 1 wherein said signal source which is 180° out of phase with respect to said first-mentioned signal source comprises a phase shifter connected between the first-mentioned signal source and said second coil.

* * * * *